United States Patent [19]

DiVincenzo

[11] Patent Number: 4,771,254

[45] Date of Patent: Sep. 13, 1988

[54] CIRCUIT BREAKER MAGNETIC TRIP UNIT

[75] Inventor: Gregory T. DiVincenzo, Plainville, Conn.

[73] Assignee: General Electric Company, New York, N.Y.

[21] Appl. No.: 92,981

[22] Filed: Sep. 4, 1987

[51] Int. Cl.[4] ..... H01H 75/10; H01H 77/06

[52] U.S. Cl. ..... 335/38; 335/203; 335/236

[58] Field of Search ..... 335/35, 37, 38, 124, 335/126, 172, 236, 177, 182, 184, 203

[56] References Cited

U.S. PATENT DOCUMENTS 3,421,123 1/1969 Johnson et al. ..... 335/35

4,609,898 9/1986 Seymour et al. ..... 335/202

4,679,016 7/1987 Ciarcia et al. ..... 335/132

4,706,054 11/1987 Hampton et al. ..... 335/203

*Primary Examiner*—Clifford C. Shaw

*Assistant Examiner*—L. Donovan

*Attorney, Agent, or Firm*—Richard A. Menelly; Walter C. Bernkopf; Fred Jacob

[57] ABSTRACT

A magnetic trip unit for molded case circuit breakers includes a pair of U-shaped magnets opposedly arranged around a part of the circuit breaker load strap and the armature strap. Circuit current in excess of a threshold value displaces the armature strap, causing it to articulate the circuit breaker operating mechanism to interrupt the circuit current.

12 Claims, 3 Drawing Sheets

CIRCUIT BREAKER MAGNETIC TRIP UNIT

BACKGROUND OF THE INVENTION

Molded case circuit breakers rated for residential and lower current industrial applications utilize both thermally responsive as well as magnetically responsive trip units for overcurrent and short circuit interruption. The thermal element responds to moderate overcurrent conditions, whereas the magnetic trip unit responds to severe overcurrent conditions. It is a current practice of the circuit protector industry to mount the magnet portion of the magnetic trip unit around the bimetal trip unit and to arrange the armature as part of the circuit breaker latching system. The magnet portion is generally U-shaped in configuration and surrounds the circuit breaker load strap or the thermal element and responds in a manner similar to that of a conventional U-shaped "slot motor" wherein the magnetic forces induced within the magnet are concentrated at the ends of the magnetic arms. The flat plate armature is arranged perpendicularly across the arms with an air gap between the arms and the armature to set the magnetic force. The magnetic force of attraction between the armature and the magnet is such that the minimum magnetic force occurs at the instant of short circuit overload since the magnet and the armature are at their furthest distance apart and the high reluctance air gap at this time is a maximum. As the armature moves toward the magnet under the magnetic force of attraction, the gap distance decreases causing the effective magnetic force to rapidly accelerate. The magnetic force is at a maximum upon the instant of contact between the armature and the magnet, at which time the air gap is effectively zero. One example of a state of the art thermal magnetic trip unit is found within U.S. Pat. No. 4,609,898 in the names of Raymond Seymour et al.

It has since been determined that the magnetic trip sensitivity can be substantially increased by utilizing a pair of opposing magnets wherein one of the magnets is fixed and the other is allowed to move, similar to an armature but opposite in direction. The magnetic forces between the magnets are of repulsion and hence the maximum magnetic force occurs at the instant of an overcurrent condition and decreases thereafter as the movable magnet becomes displaced and the high reluctance air gap correspondingly increases. In most circuit breaker designs, it is important to generate a trip force at the instant of overcurrent occurrence such that the largest magnetic trip force occurs instantaneously. In some breaker applications, the thermal trip unit is eliminated such that both long time overcurrent as well as short circuit trip functions are provided by means of a magnetic dashpot trip unit alone. A "dashpot" is an arrangement wherein a magnetic plunger is arranged within a viscous liquid which is encapsulated within a sealed container. A solenoid winding around the container generates a magnetic force in proportion to circuit current. The viscosity of the liquid provides the time overcurrent delay similar to the thermal trip unit. Upon the occurrence of a short circuit condition, the magnetic force generated by the solenoid winding is sufficient to rapidly overcome the liquid velocity to trip the breaker.

The purpose of this invention is to provide a simple magnetic trip unit having sensitive response to both overcurrent as well as short circuit conditions.

SUMMARY OF THE INVENTION

A magnetic trip unit for molded case circuit breakers wherein a magnet is arranged around the load strap at one end of the breaker in magnetic proximity to a second magnet arranged around the armature strap. Current transport through the load strap and the armature strap generates opposing magnetic forces to articulate the circuit breaker operating mechanism when the current exceeds a threshold value.

DESCRIPTION OF THE PREFERRED EMBODIMENT

Figure 1:
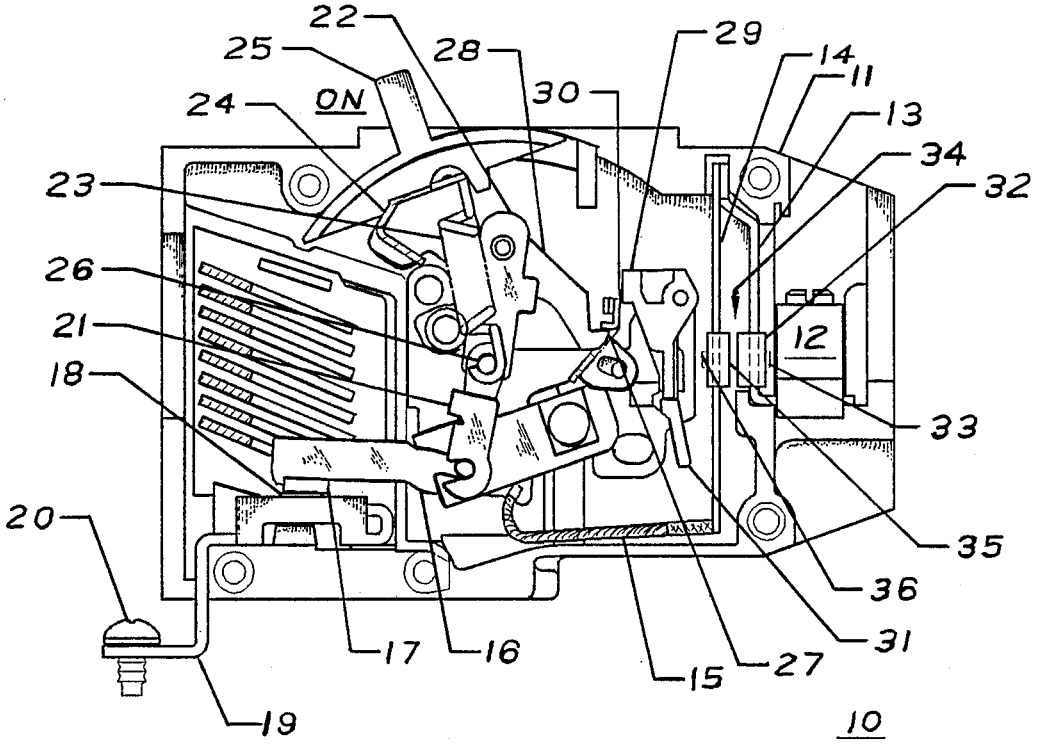
FIG. 1 is a side view of a molded case circuit breaker employing the magnetic trip unit according to the invention.

A molded case circuit breaker 10 is shown in FIG. 1 consisting of a plastic case 11 to which electrical connection with a load is made by means of load terminal 12 and load strap 13. The circuit through the breaker proceeds through an armature strap and braid conductor 15 to the movable contact arm 16 having a movable contact 17 attached thereto. Electrical connection through the breaker is completed by means of a fixed contact 18, which connects by means of a line strap 19 with the line terminal screw 20. The movable contact arm 16 operatively connects with an operating handle 25 by means of lower link 21, upper link 22, operating spring 23 and handle yoke 24. The upper and lower links are pivotally connected by means of a pivot pin 26 to which the operating spring 23 connects and which moves the upper and lower links over center when the operating handle is in the ON position, as indicated. The contacts are held in a closed position against the bias provided by the stretched operating springs 23 by the engagement between the end of the cradle 28 with the bottom surface of the primary latch 27. A secondary latch 29 interferes with the back surface 30 of the primary latch to prevent the release of the end of the cradle 28 from the primary latch.

The breaker is similar to that described within U.S. Pat. No. 4,679,016 entitled "Interchangeable Mechanism For Molded Case Circuit Breaker". This Patent is incorporated herein for purposes of reference and review should be made thereof for a good understanding of the interaction of the latch with the operating mechanism. A trip bar 31 articulates the operating springs 23 by moving the secondary latch 29 out of contact with the primary latch 27, to thereby allow the cradle 28 to release from the primary latch and to allow the upper and lower links 22, 21 to collapse under the bias of the operating springs to draw the movable contact arm 16 and the movable contact 17 to the open position. A magnetic trip unit 34, according to the instant invention, consists of a first magnet piece 32 encompassing a part of the load strap 13 and attached thereto by means of a rivet 33. A second magnet piece 35 attached by means of a rivet 36 is arranged in magnetic opposition to the first magnet piece 32. A magnet force induced within the first magnet piece upon transport of circuit current through the load strap opposes the magnetic force induced within the second magnet piece by the transport of circuit current through the armature strap 14. Upon reaching an overload threshold current value, the magnetic forces drive the magnet piece 35 and the attached armature strap 14 against the trip bar 31 causing it to displace the secondary latch 29 and thereby articulate the operating springs 23. Resetting the circuit breaker operating mechanism by moving the operating handle 25 beyond the OFF position to engage the end of the cradle 28 with the primary latch 27 and then to the ON position to close the contacts 17, 18 and to bring the operating springs 23 to their over center position also returns the armature strap 14 to its original position.

Figure 2:
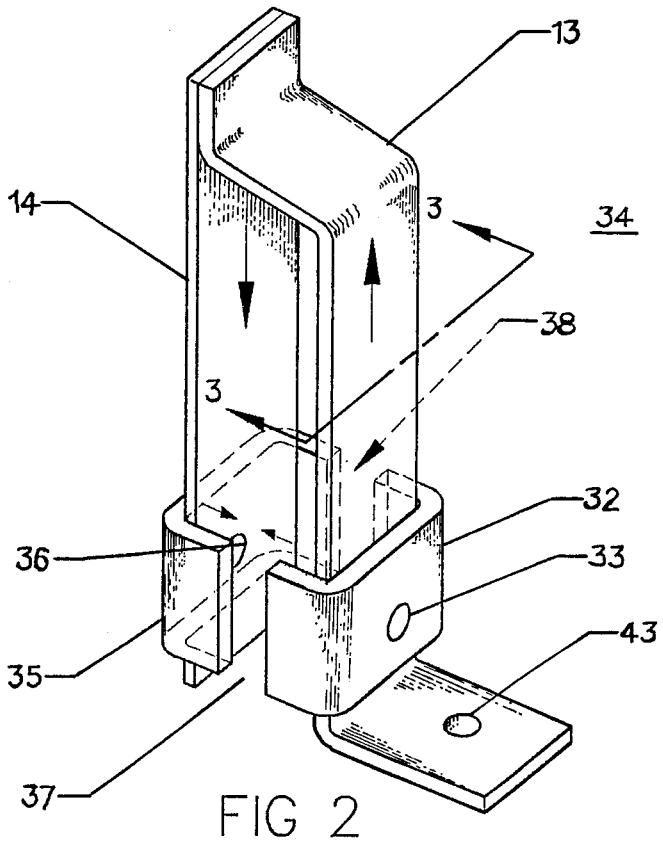
FIG. 2 is a top perspective view of the magnetic trip unit within the circuit breaker of FIG. 1.
Figure 3:
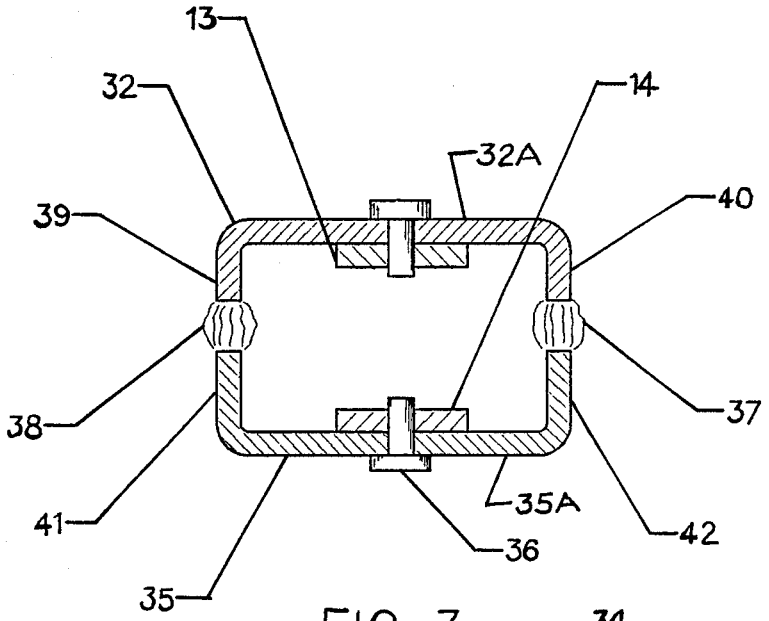
FIG. 3 is a top sectional view of the magnetic trip unit of FIG. 2 through the plane 3—3.

The magnetic trip unit 34 is depicted in FIGS. 2 and 3 to detail the configuration of the load strap 13, which is joined to the armature strap 14 at one end by welding or brazing and is provided with a thru-hole 43 at a flattened portion of the opposite end for ease in connecting with the load terminal stud 12 (FIG. 1). As described earlier, the first magnetic piece 32 is attached to the load strap by means of the rivet 33 and the load strap is fixedly held by means of the attachment with the load terminal stud 12 (FIG. 1) while the armature strap 14 attached to the second magnetic piece 35 by rivet 36 is free to pivot along with the second magnetic piece 35, when the threshold value of current is exceeded and opposing magnetic fields are generated across the air gaps 37, 38 that separate the magnetic pieces.

As best seen in FIG. 3, a pair of arms 39, 40 extending from the bight plate 32A on magnet piece 32 and arms 41, 42 extending from a bight plate 35A on magnet piece 35 effectively concentrate the magnetic flux B across the air gaps 37, 38 to increase the magnetic repulsion between the magnet pieces.

Figure 4:
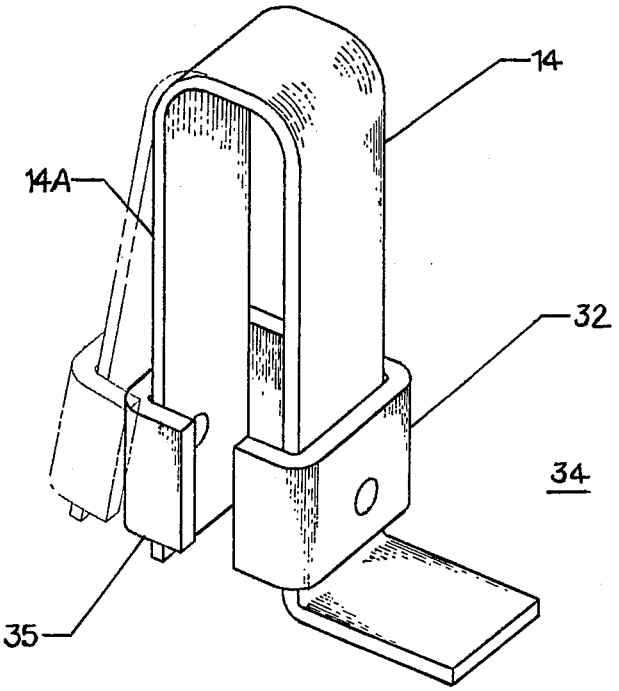
FIG. 4 is a front perspective view of a further embodiment of the magnetic trip unit of FIG. 2.

A magnetic trip unit 34 is shown in FIG. 4 wherein a U-shaped armature 14 is attached to both magnetic pieces 32, 35 in lieu of a load strap. The movable leg 14A of the U-shaped armature containing the magnet piece 35 moves in response to magnetic repulsion as indicated in phantom, whereas the magnet piece 32 remains stationary.

Referring again to the magnetic trip unit depicted in FIGS. 2 and 3, wherein a U-shaped armature 14 is arranged within the magnet pieces 32, 35, it is proposed to replicate the trip action performed by a bimetal trip element commonly employed within thermal-magnetic trip devices by careful selection of the magnetic properties selected for the magnet pieces 32, 35. When an overload current condition passes through the U-shaped armature that is less than a threshold trip value, the magnet piece 35 is repelled away from magnet piece 32, as indicated in phantom. Since the magnetic force induced by each of the magnet pieces 32, 35 is inversely proportional to the gap separation distance, the air gaps 37, 38 shown in FIG. 3 increase slightly upon the overload condition less than a predetermined threshold value. With materials having low magnetic remnance, such as low carbon steel, the movable leg 14A of the U-shaped armature 14 and the attached magnet piece 35 as best seen in FIG. 4 would return to its original position, when the overload condition ceases. Should an overload condition occur within a short period of the earlier overload condition, the movable leg 14A would again become displaced to that indicated in phantom. When a bimetal is commonly employed as a thermal sensing element the bimetal becomes heated upon the occurrence of an overload condition and moves away from its initial quiescent position. Upon cessation of the overload condition, the bimetal retains some of the heat generated during the overload condition and does not immediately return to its original quiescent position. Should an overload condition occur shortly thereafter, the residual heat or thermal "memory" from the earlier overload condition substantially adds to the heat generated by the subsequent overload to displace the bimetal a sufficient distance to thereby contact the trip bar and articulate the operating mechanism.

For the magnetic trip unit 34 of the previous figures to replicate the thermal "memory" of a bimetal, it is desirable, therefore, to select the material for the magnet piece 35 on the movable arm 16 to have some magnetic remnance, or "memory" such that the movable leg 14A does not completely return to the original quiescent position should an overload occur immediately after the first overload. The magnetic remnance is a function of the material selected as well as the processing employed to both form and treat the metal. For those metals having temporary magnetic remnance such that the residual magnetism after overload dissipates at a rate corresponding to the cool down of a bimetal, the magnetic trip unit would then provide tripping response over a wide range of current.

Figure 5:
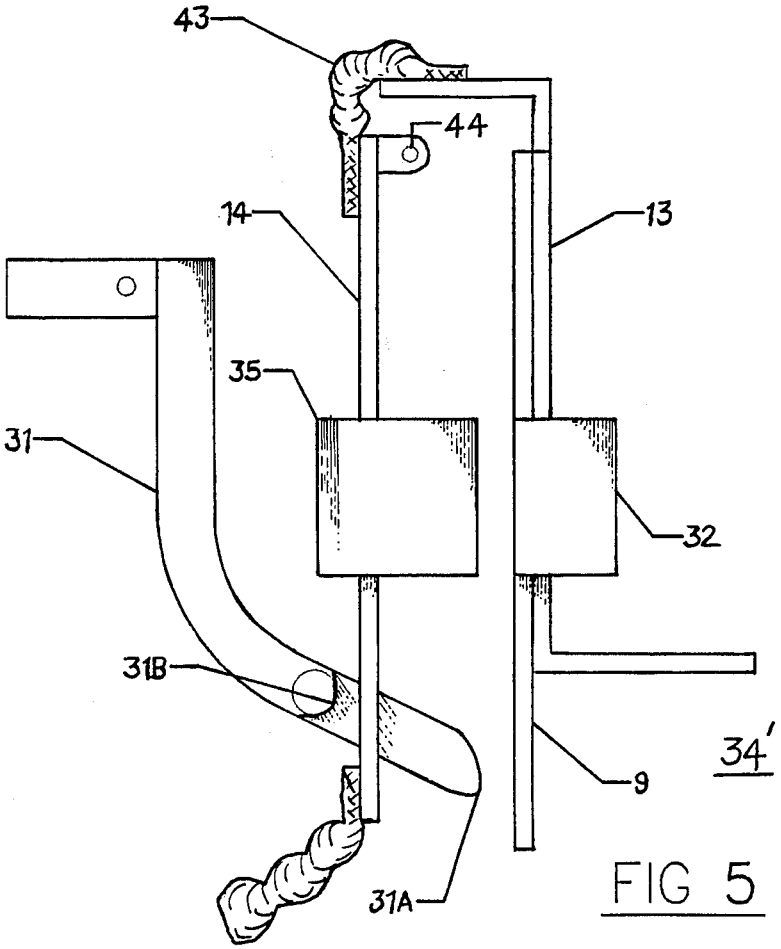
FIG. 5 is a front perspective view of a further embodiment of the magnetic trip unit of FIG. 2.

A combined thermal-magnetic trip unit 34' is depicted in FIG. 5 wherein the load strap 13 has a bimetal element 9 welded or brazed at one end and is connected to the armature strap 14 by means of a conductive braid 43. The armature is pivoted by means of a pivot pin 44 supported by the circuit breaker case 11 (FIG. 1). The first magnet piece 35 partially surrounds both the load strap 13 and the bimetal 9. The load strap becomes heated during transfer of current through the circuit breaker and transfers heat to the bimetal to cause the bimetal to become operative. The second magnet piece 35 partially surrounds the armature 14 such that the armature responds to the magnetic repulsion between the first and second magnetic pieces 32, 35 as described earlier. The trip bar 31, similar to that shown in FIG. 1, is arranged for interacting with both the bimetal 9 and the armature 14. The end 31A of the trip bar is arranged next to the bimetal 9 while a projection 31B on the trip bar is arranged next to the armature 14. In this thermal-magnetic device, the bimetal responds thermally to long term overcurrent conditions to strike the end 31A of the trip bar whereas the armature responds to short time overcurrent conditions of larger magnitude to strike the projection 31B of the trip bar to trip the breaker.

It has thus been shown that a magnetic trip unit having enhanced magnetic sensitivity is provided by magnetic pieces opposingly arranged on U-shaped bimetals, U-shaped load straps as well as the combination of a load strap with a bimetal attached thereto and pivoting armature.

Having thus described my invention, what I claim as new and desire to secure by Letters Patent is:

1. A molded case circuit breaker comprising:

a pair of first and second separable contacts, said first contact being adapted for electrical connection with a source of electric current through a line strap conductor and said second contact adapted for electrical connection with an electric load through a load strap conductor;

an operating mechanism arranged for separating said contacts to interrupt said electric current when said electric current exceeds a first threshold value;

an armature connected with said load strap for articulating said operating mechanism when said electric current exceeds said first threshold value;

a first U-shaped metal plate encompassing a part of said load strap conductor and providing a magnetic force in a first direction upon transport of said electric current through said load strap conductor; and a second U-shaped metal plate encompassing a part of said armature and providing a magnetic force in a second direction opposite said first direction upon transport of said electric current through said armature, said first and second magnetic force causing said armature to articulate said operating mechanism when said electric current exceeds said first threshold value.

2. The molded case circuit breaker of claim 1 wherein said first U-shaped metal plate is attached to said load strap.

3. The molded case circuit breaker of claim 1 wherein said second U-shaped metal plate is attached to said armature.

4. The molded case circuit breaker of claim 1 wherein said first U-shaped metal plate comprises a first pair of arms joined by a first bight plate.

5. The molded case circuit breaker of claim 4 wherein said first pair of arms extend perpendicularly from said first bight plate.

6. The molded case circuit breaker of claim 1 wherein said second U-shaped metal plate comprises a second pair of arms joined by a second bight plate.

7. The molded case circuit breaker of claim 6 wherein said second pair of arms extend perpendicularly from said second bight plate.

8. A molded case circuit breaker comprising:

a molded case;

a pair of first and second separable contacts within said molded case, said first contact adapted for electrical connection with a source of electric current through a line strap conductor at one end of said case, said second contact adapted for electrical connection with an electric load through a load strap conductor at an opposite end of said case;

an operating mechanism arranged for separating said first and second contacts to interrupt said electric current when said electric current exceeds a first threshold value;

thermal responsive means connected with said load strap conductor for articulating said operating mechanism when said electric current exceeds said first threshold value;

a first U-shaped metal plate encompassing a part of said load strap conductor and consisting of a first pair of extending arms joined by a bight plate, said first U-shaped metal plate providing a first magnetic force upon transport of said electric current through said load strap conductor;

an armature electrically connected with said load strap and extending parallel to said thermal responsive means;

a second U-shaped metal plate encompassing a part of said armature and consisting of a second pair of extending arms joined by a bight plate, said second U-shaped metal plate providing a second magnetic force in opposition to said first magnetic force, said second U-shaped metal plate displacing said armature to articulate said operating mechanism when said electric current exceeds said first threshold value.

9. A molded case circuit breaker comprising:

a pair of first and second separable contacts, said first contact being adapted for electrical connection with a source of electric current through a line strap conductor, said second contact being adapted for electrical connection with an electric load through a load strap conductor;

an operating mechanism arranged for separating said first and second contacts to interrupt said electric current when said electric current exceeds a first threshold value;

latching means arranged for preventing said operating mechanism from separating said contacts;

thermal responsive means connected with said load strap conductor for articulating said operating mechanism when said electric current exceeds said first threshold value;

a trip bar interfacing between said latching means and said thermal responsive means whereby said thermal responsive means contacts a first part of said thermal means when said circuit current exceeds said first threshold value to move said trip bar into releasing contact with said operating mechanism to release said operating mechanism and thereby separate said contacts;

a first U-shaped metal plate encompassing a part of said thermal responsive means and said load strap and providing a first magnetic force upon transport of said electric current through said load strap; and an armature electrically connected with said load strap and extending proximate a second part of said trip bar;

a second U-shaped metal plate encompassing a part of said armature and providing a second magnetic force upon transport of said electric current through said armature, said second magnetic force opposing said first magnetic force to cause said armature means to contact said second part of said trip bar to move said trip bar into releasing contact with said operating mechanism when said circuit current exceeds said second threshold.

10. The molded case circuit breaker of claim 9 wherein said thermal responsive means comprises a U-shaped bimetal.

11. The molded case circuit breaker of claim 9 wherein said thermal responsive means comprises a shaped memory element.

12. A molded case circuit breaker comprising:

a pair of first and second separable contacts;

an operating mechanism arranged for separating said contacts to interrupt said electric current when said electric current exceeds a threshold value;

a U-shaped load strap conductor adapted for electrical connection with an electric load;

a line strap conductor adapted for electrical connection with a source of electric current;

a first U-shaped metal plate encompassing a first part of said U-shaped load strap conductor and providing a magnetic force in a first direction upon transport of said electric current through said first part of said U-shaped load strap conductor; and a second U-shaped metal plate encompassing a second part of said U-shaped load strap conductor and providing a magnetic force in a second direction upon transport of said electric current through said second part of said U-shaped load strap conductor, said first and second magnetic forces being in opposition to each other, said first part of said U-shaped load strap conductor becoming displaced into contact with said operating mechanism to articulate said operating mechanism when said electric current exceeds a threshold value.

* * * * *